United States Patent [19]

Zeitlin et al.

[11] 4,259,295

[45] Mar. 31, 1981

[54] OXALIC ACID LEACHING OF MARINE NODULES

[75] Inventors: Harry Zeitlin, Honolulu, Hi.; Quintus Fernando, Tucson, Ariz.

[73] Assignee: University Patents, Inc., Norwalk, Conn.

[21] Appl. No.: 102,490

[22] Filed: Dec. 11, 1979

Related U.S. Application Data

[63] Continuation of Ser. No. 674, Jan. 3, 1979, abandoned, which is a continuation-in-part of Ser. No. 882,930, Mar. 1, 1978, abandoned.

[51] Int. Cl.[3] ..... C01G 3/00; C01G 53/00; C01G 51/00

[52] U.S. Cl. ..... 423/24; 423/27; 423/49; 423/139; 423/150

[58] Field of Search ..... 75/101 R, 121; 423/24, 423/27, 49, 50, 139, 150, DIG. 4

[56] References Cited

U.S. PATENT DOCUMENTS

| | | | |
|---|---|---|---|
| 3,511,645 | 5/1970 | Goni | 75/121 |
| 3,853,618 | 12/1974 | Smith | 423/24 |
| 3,923,615 | 12/1975 | Kane et al. | 423/49 |
| 4,029,733 | 6/1977 | Faugeras | 423/150 |

FOREIGN PATENT DOCUMENTS

| | | | |
|---|---|---|---|
| 620576 | 4/1927 | France | 75/101 R |

OTHER PUBLICATIONS

Agarwol et al. "Processing of Ocean Nodules: A Technical and Economic Review", *Journal of Mines,* vol. 28, No. 4, Apr. 1976.

*Primary Examiner*—Brian E. Hearn

[57] ABSTRACT

Metal values of ferromanganese nodules harvested from ocean floors are placed in aqueous solution suitable for partition as by selective extraction with chelating agents by treating the nodules with aqueous solutions which contain oxalic acid or mixture of oxalic acid with a strong acid. These unique reagents may be used alone or in combination with other reducing, complexing or acidic treating agents.

12 Claims, 2 Drawing Figures

OXALIC ACID LEACHING OF MARINE NODULES

This application is a continuation of our prior U.S. application: Ser. No. 674, Jan. 3, 1979, and which is a continuation-in-part of application Ser. No. 882,930, Mar. 1, 1978, both now abandoned.

FIELD OF THE INVENTION

This invention is concerned with improvement of hydrometallurgical extraction of copper, nickel and cobalt values present as minor components of the ferromanganese nodules known to be present in large quantities distributed on the floors of the oceans. More particularly, the invention provides capability to convert the metal content of such nodules to water soluble form in aqueous solution from which minor components such as copper, cobalt and nickel are readily separable by partition into water immiscible media such as hydrocarbon solutions of suitable chelating agents.

BACKGROUND OF THE INVENTION

Presence of ferromanganese nodules on floors of the oceans has been known for over a hundred years due to reports by the British ship Challenger of results of the first long oceanographic voyage. With development of undersea cameras, it was found that these nodules occur very widely through the oceans and are present in vast quantities. The nodules vary widely in size and configuration. Chemical composition is somewhat variable but characteristically they are composed of metal oxides believed to be deposited at a very slow rate together with variable amounts of (probably occluded) non-metallic components such as silica, carbonate minerals and the like.

The metallic components of the nodules are primarily manganese and iron oxide. The nodules are found to be composed of extremely fine grains of manganese and iron oxide minerals of which todorokite, birnesite and delta manganese dioxide have been identified as manganese components. The only iron mineral which has been recognized is geothite, FeOOH. The nodules also contain smaller amounts of a large number of other metals, of which copper, cobalt and nickel are particularly interesting as a source for supply of industrially important metals for which land sources are becoming scarce. The form in which these minor components are present has not been firmly identified. Studies of chemical reactivity suggest that the metals other than manganese and iron occur as integral parts of the iron and manganese minerals. Possible proposed mechanisms include substitution in crystal lattices, ion exchange and adsorption. Whatever their form, the nickel and copper appear to be primarily associated with the manganese matrix and the cobalt with the iron matrix. Although it is known that different regions of a nodule may be relatively rich in one or the other of these groups of associated metals, no physical method has been described for concentration of either the iron or manganese component.

In recognition of the approaching scarcity of land supplies for some of the important metals, attention has been directed to methods for recovering the enormous amounts of nickel, cobalt and copper known to be present in ferromanganese nodules which can be dredged from the bottoms of the seas. There have been studies conducted which indicate that pyrometallurgy is unlikely to be an economic approach to winning of these metals from the deep sea nodules. Consequently, current investigations are primarily concerned with hydrometallurgy as the more promising approach. It has been recognized that the manganese dioxide of the manganese minerals must be reduced to a form which provides water soluble salts, e.g., manganous ion. Such dissolution of the manganese matrix with concurrent dissolution of the iron matrix releases the contained desirable metals for solution in an aqueous medium from which metal values may be extracted by various techniques, such as ion exchange with water immiscible solutions of chelating agents. The dissolution step can be conducted to leave the bulk of non-metallic mineral matter undissolved, simplifying operation of the subsequent step for recovery of desired metals.

Previously known dissolution techniques generally involve high energy consumption and pose environmental problems in disposal of spent reagents and by-products of the process. Sulfur dioxide can reduce the manganese dioxide and has been the reagent employed for that purpose in a number of reported studies. Sulfur dioxide is applied under high pressure or high temperature or both and leaves a problem of disposal of the sulfuric acid and sulfates generated by the reaction. The high requirements for power to operate compressors and/or for heat make this operation very unattractive for use on vessels at sea. Even at land based installations, the process is expensive. In either event, the streams discharged from the system pose a serious problem of environmentally acceptable disposal.

Dissolution by acetic acid is among the methods studied by Brooke and Prosser, as reported at Inst. Min. Metall. Trans. Sec. C, 78, C 64 (1969).

SUMMARY OF THE INVENTION

The invention provides for dissolution of ferromanganese nodules by reagents which yield the environmentally acceptable by-products water and carbon dioxide and produce a solution of salts of the desired metals together with salts or iron, manganese and trace metals which is separated from a solid residue of silica and other undissolved solids. Following adjustment of pH by ammonia, the solution of ammines of transition metals is extracted with solution of chelating agents in water immiscible liquids such as kerosene.

The effective dissolution reagents are oxalic acid and mixtures of oxalic acid with strong acids such as sulfuric acid. The oxalic acid acts as a reducing agent to disrupt the manganese dioxide grains. In addition the metals are taken into solution as salts or complexes of the organic acid. Upon addition of ammonia to adjust pH for the subsequent extraction step, ammine complexes of the transition metals are also formed. The desired metals are then recovered from that solution of salts, complexes and the like by selective extraction with chelating agents, sometimes referred to as "liquid ion exchange" (LIX) reagents.

The results obtained in accordance with the present invention are quite unexpected and surprising particularly in view of the lack of reactivity of $Fe_2O_3$ with oxalic acid, notwithstanding the suggestion that oxalic acid can be used for recovery and dissolution of iron from iron ores. Surprisingly, ferric oxide, $Fe_2O_3$, can be added to oxalic acid solution and the mixture allowed to stand for a period of several days with no observable reaction. On the other hand, oxalic acid does react, and rapidly, with manganese dioxide. It is not obvious that the iron oxide matrix in ferromanganese nodules will break down on treatment with oxalic acid whereas the iron oxide matrix in $Fe_2O_3$ does not react at a measurable rate with oxalic acid.

Surprisingly, oxalic acid does react with ferromanganese nodules to dissolve completely both the iron oxide and manganese dioxide matrices. These results are in direct apposition to the lack of any appreciable reactivity of $Fe_2O_3$ with oxalic acid, and further highlights the uniqueness of ferromanganese sea nodules so that they should not be classified as "ores" in the usual sense of the word. They are unique because they are structurally different from the usual ores. Current theory considers that copper, nickel and cobalt are substituents at various locations in the host crystal lattices. Such structures, of course, are quite different from ores that usually contain these metals as oxides, sulfides, etc. Thus, the unique nature of sea nodules dictates that new technology be developed to recover the desired metal values.

DESCRIPTION OF THE DRAWINGS

The effects of certain variables in the process of the invention are illustrated graphically in the drawings wherein.

DESCRIPTION OF PREFERRED EMBODIMENTS

In practicing the invention, ferromanganese nodules are treated with an aqueous solution of oxalic acid or a mixture of oxalic acid with a strong acid such as sulfuric acid which forms water soluble salts or complexes of transition metals and possesses certain other characteristics utilized by the invention. The suitable acids form strongly acidic aqueous solutions capable of dissolving the iron oxide found in ferromanganese nodules. The organic acid used is characterized by a capability to rapidly reduce manganese dioxide. The acid used in admixture with oxalic is a strong acid such as sulfuric. The term "strong acid" is used in the accepted sense of including those acids of which the dissociation constant is not susceptible of accurate measurement in aqueous solution. These acid solutions are used in a concentration which will accomplish the desired dissolution to a substantial extent. In general, the solution should be at least 0.1 molar up to the limit of solubility of the acid in water. Generally, the saturated solutions contain more acid than is needed and hence involve unnecessarily high expense for the organic acid. For any given acid or mixture of acids, a concentration should be selected which represents the minimum needed to accomplish the desired degree of dissolution. At treatment levels of 200 mL of oxalic acid solution to about 1.5 grams of ferromanganese nodules, dissolution was obtained at oxalic acid concentrations between about 0.1 M and 0.5 M, preferably in the neighborhood of 0.25 M.

Figure 1:
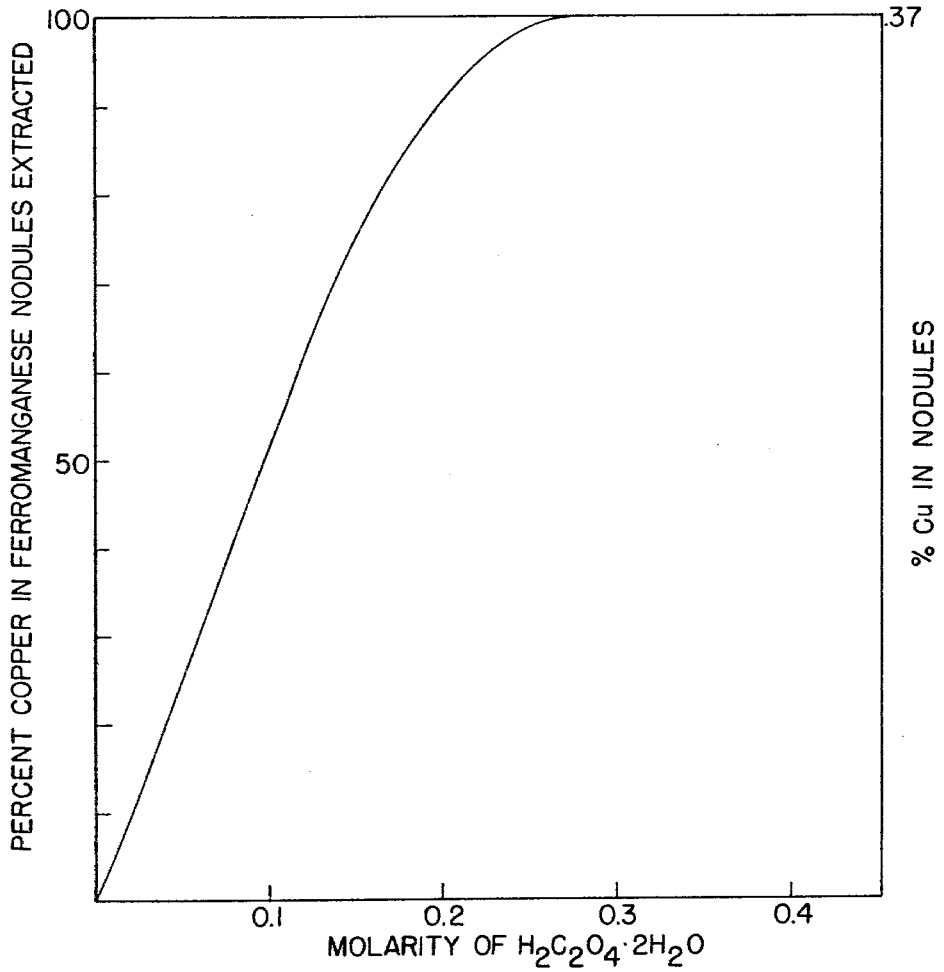
FIG. 1 represents the variation in percentage of copper extracted from ferromanganese nodules by aqueous solutions of oxalic acid at different concentrations of acid.

The effect of concentration of the acid is typified by FIG. 1 which shows graphically the degree of copper rendered soluble by oxalic acid at various concentrations.

Of all the commercially available oragnic acids, oxalic acid is preferred. Oxalic acid can disrupt the manganese dioxide matrix in an oxidation-reduction reaction in which the acid is oxidized to carbon dioxide and water and the manganese dioxide is reduced to the manganous ion $Mn++$. Oxalic is a reasonably strong dicarboxylic acid (i.e., it has large $K_a$ values). It can disrupt the iron oxide matrix and even reduce FeIII to FeII. This reduction however occurs slowly over a period of several hours. Oxalic acid is also a complexing agent which can solubilize the metals of ferromanganese nodules, including copper, nickel and cobalt. The silica and aluminosilicates remain as a precipitate and can be readily separated in the dissolution step.

In its preferred form, the dissolution step is carried to completion by the action of the organic acid, along or in admixture with a strong acid, but the invention is adapted to a two stage dissolution by a first leaching with an acid such as oxalic to disrupt the manganese dioxide matrix followed by a second leaching with an acid such as sulfuric to disrupt the iron oxide matrix. In that modification, the two leach liquors are preferably combined for further processing.

In practice of a preferred embodiment, the milled ferromanganese nodules are treated with 0.25 M solution of oxalic acid, whereupon the manganese dioxide matrix is reduced with concomitant evolution of carbon dioxide. In the course of its reaction with manganese dioxide, the acid solution assumes a brown color. When subsequent dissolution of the iron matrix is complete, say after about 15 minutes, the solution is bright yellow in color. The unreacted material is hydrated silica and aluminosilicates which can be separated by filtration. The filtrate, at pH 1.0 to 1.5, consists of a water solution of mixed soluble metal oxalates. An addition of ammonia to adjust pH will give the ammine complexes of the transition metal ions. If sufficient ammonia be added to raise the pH to greater than about 9, hydroxy complexes as well as mixed ligand complexes can be present. It is from these solutions which contain a multitude of metal complexes in addition to an excess of the bidentate ligand $C_2O_4^{2-}$, and the monodentate ligands $NH_3$ and $OH^-$, that the copper, nickel and cobalt are selectively extracted.

By conducting extractions at successively higher pH values obtained by step wise adjustment of pH with $NH_3$, separations among the dissolved metals are feasible. Using a 1.5% solution in kerosene of chelating agent (LIX 64N) constituted by a mixture of 2-hydroxy-5-nonylbenzophenoneoxime and 5,8-diethyl-7-hydroxy-6-dodecaneoxime in a ratio of 45 to 1, copper is completely extracted at pH 6.75, whereas negligible amounts of nickel, cobalt, manganese and iron are extracted. A variety of factors including stability constants of complexes, distribution coefficients between aqueous and organic phases, acid dissociation constants of ligands, concentrations of various species control the extent of extraction of copper. These have not been evaluated to the extent necessary to explain the observed incomplete extraction of copper with this chelating agent at pH below 6.75.

The complete extraction of nickel occurs at pH 8.8, which is about two units higher than the pH at which copper is completely extracted. It is possible therefore, to quantitatively separate copper and nickel from the solution of metal oxalates by merely adjusting the pH of the aqueous phase, first to a value of 6.75 and extracting with a 1.5% solution of LIX 64N and then increasing the pH of the aqueous phase to 8.8 by the addition of ammonia and repeating the extraction with the LIX 64N. At a pH of 8.8, however, most of the iron and cobalt and about 10% of the manganese that is present in solution were also extracted. It is uneconomical to extract iron from the ferromanganese nodules and consequently it should be treated as a contaminant of the organic phase containing the nickel and cobalt.

A slightly modified approach was employed to separate the iron contaminant from the organic phase. The pH of the solution containing the dissolved ferromanganese nodules was adjusted to 7.1 with $NH_3$ and extracted with LIX 64N. The copper was completely extracted together with approximately 17% of the cobalt in solution. No nickel, manganese or iron were extracted. The pH of the aqueous phase was then increased to 9.1 by the addition of a further quantity of $NH_3$ and the solution allowed to stand for approximately an hour. The iron was almost completely precipitated as the hydroxide and separated. The resulting aqueous phase, when treated with LIX 64N, extracted 70–75% of the nickel and cobalt remaining in the aqueous phase. The manganese was not extracted to any appreciable extent by LIX 64N under the above conditions and remained almost exclusively in the aqueous phase. The precipitate of iron hydroxide was found to have coprecipitated small amounts of cobalt, nickel and manganese.

Generally, the pH of the solution obtained by oxalic acid dissolution of ferromanganese is raised to a pH value above about 5 by addition of ammonia before extraction with a chelating agent. The particular pH for optimum results will vary with the chelating agent chosen and other variables briefly noted above to provide maximum effectiveness of the chelating agent in its competition with aqueous phase ligands for the metal ions.

Figure 2:
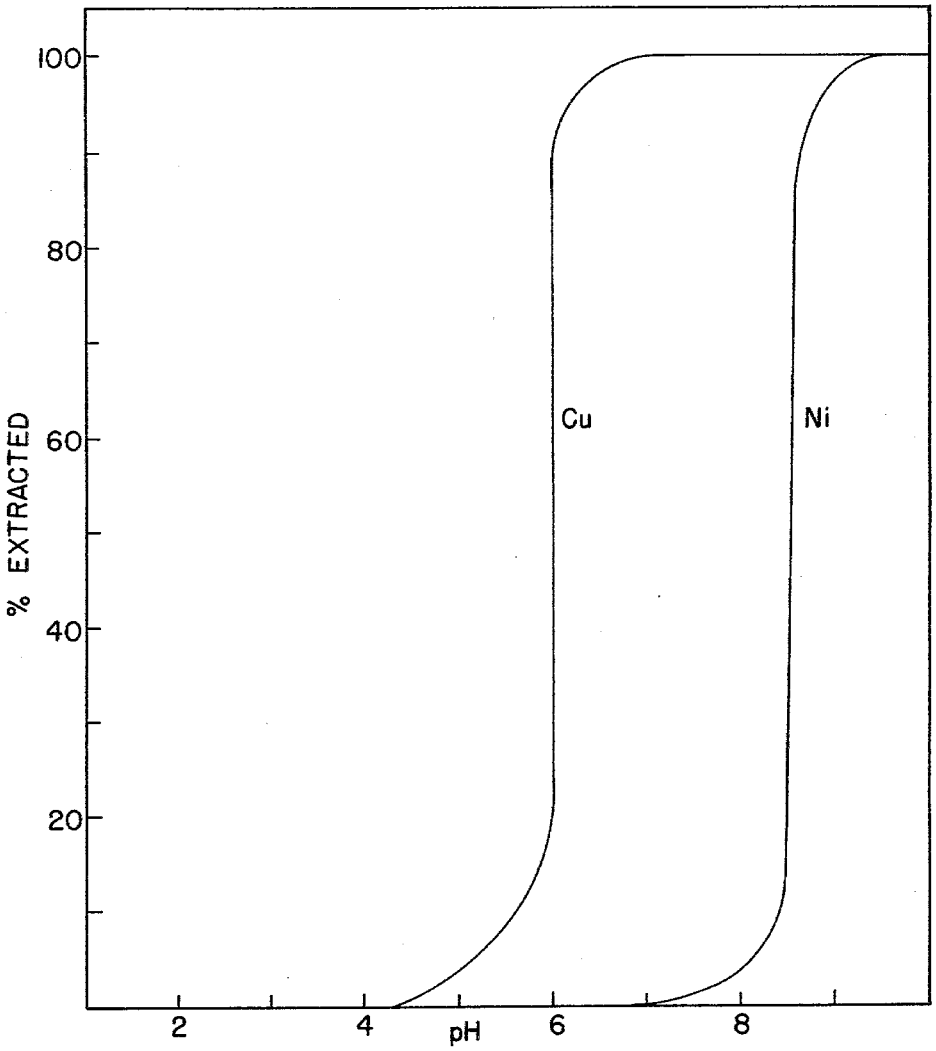
FIG. 2 represents the variation in percentage of copper and nickel extracted by a chelating agent at different pH levels from an aqueous oxalate solution obtained by oxalic acid dissolution of ferromanganese nodules.

The variation with pH in percent of dissolved copper and nickel recovered by extraction with the specific chelating solution described above is shown graphically in FIG. 2.

The metal values are effectively recovered from the chelate solute by springing with a mineral acid such as sulfuric after the manner known in the art.

As an alternative to the use of only oxalic acid in the leaching step, a combination of oxalic acid and strong acid leaching can be used to appreciably reduce the costs of the inventive process, particularly for large-scale operations.

The ferromanganese nodules can be leached with a mixture of strong acid, e.g., sulfuric acid or hydrohalic acid, such as hydrochloric acid, and oxalic acid usually employing a series of several leaching steps until the residue is hydrated silica which may contain small amounts of precipitate Iron (II) oxalate. As a further embodiment of this aspect of the invention, the treatment with a mixture of oxalic and sulfuric acids may be preceded by leaching with mineral acid containing no oxalic acid. This preliminary leaching step has the added advantage of effecting a preliminary separation of copper values from the Ni and Co values. For example, using 2 M. sulfuric acid as leaching solution in two successive leaching steps, about 90% of Cu is separated in the leaching solution while none of the Co and only about 15% of the Ni is separated from the nodule ore. The subsequent leaching with oxalic and sulfuric acids dissolves the remainder of Ni and the Co values in the nodules.

A specific procedure illustrative of the stepwise leaching and separation follows. Manganese nodules are leached in two successive steps with 2 M. sulfuric acid (100 ml./g. of nodules) and finally with a mixture that consists of 2 M. $H_2SO_4$ and 0.03 M. oxalic acid (100 ml./g. of nodules). The time of contact for each step is 25 minutes at 25° C. The undissolved solid at the end of three successive leaching steps consists mainly of $SiO_2.nH_2O$ together with a small amount of precipitated Iron (II) oxalate.

Approximately 50% of Fe, 90% of Cu and 15% of Ni are leached by the 2 M. $H_2SO_4$. Virtually no Co is leached by the 2 M. $H_2SO_4$. The mixture of $H_2SO_4$ and oxalic acid dissolves the remainder of Ni and Co in the nodules.

The 2 M. $H_2SO_4$ leach solutions from the first two leach steps are combined, and the pH adjusted with ammonia to about 2.4. Copper is completely extracted at this pH with 7% LIX 64N in kerosene. An aqueous solution of ammonia is added to the third step leach solution to a pH of about 9.0 where Fe precipitates as $Fe(OH)_3$ and is removed by filtration. The pH of the resulting solution is adjusted (with $H_2SO_4$) to a value of 8.3 and the Ni is almost completely extracted with the LIX 64N in kerosene. The Co is unextracted and remains in the aqueous phase.

From these data, it is apparent that mineral acid such as sulfuric acid can be substituted for part of the oxalic acid normally required in the dissolution of sea nodules in accordance with this alternate embodiment of the invention. The extent of substitution of sulfuric acid for oxalic acid will be dictated by the content of copper and other metal in the nodule ore and the required efficiency of separation of the respective metals Cu, Ni and Co. Thus, where Cu is the desired metal, the nodules can be treated continuously with sulfuric acid to extract maximum amounts of Cu from the ore. It must be recognized that significant Ni will dissolve along with the copper and the object of realizing maximum copper will result in diminished nickel values in the residual ore which is to be treated with oxalic acid for recovery of Ni and Co. Of course, nickel can be recovered from the sulfuric acid leach solutions after Cu is separated. Accordingly, the extent of use of sulfuric acid pre-treatment will to some extent necessitate change in the recovery and separation procedure. However, a necessary step in this embodiment is the treatment of the residual nodule ore with oxalic acid alone or in admixture with the mineral acid to separate nickel and cobalt as well as any amounts of copper which remain. Ordinarily, for economy, as much oxalic acid is substituted in such admixtures with sulfuric acid as is practical in view of the relative costs of the acids. For most purposes, up to about 90% of the oxalic acid normally employed can be replaced by mineral acid. Usually the minimum amount of oxalic acid required is that required to effect the requisite reduction reaction leading to evolution of carbon dioxide. Therefore, the amount of oxalic acid necessary to react with the nodule ore is easily determinable and can be metered by the evolution of carbon dioxide gas.

The amounts of mineral acid employed can be in excess of that required to replace the oxalic acid for dissolution of the reduced ore.

We claim:

1. A process for recovery of metal values from marine ferromanganese nodules comprising the steps of:

(a) leaching said nodules with an aqueous solution of oxalic acid or mixture of oxalic acid and a strong acid to thereby effect a complete dissolution of both the iron oxide and manganese dioxide matrices of said nodules and to yield a solid residue of silica and aluminosilicates and an aqueous solution containing water soluble salts of copper, nickel, cobalt, manganese, and iron;

(b) separating said solid residue from said aqueous salt solution;

(c) selectively extracting substantially all the copper from said aqueous salt solution by first adjusting the pH value of said aqueous salt solution to a value within the range of from about 6 to about 7 by addition of ammonia and thereafter contacting said aqueous salt solution with a solution in a water immiscible liquid of a liquid ion exchange chelating agent having an extraction specificity for said copper at the pH range of from about 6 to about 7;

(d) removing substantially all the iron from the resulting copper-depleted aqueous salt solution by adjusting the pH value of said aqueous salt solution to a value of about 9 by addition of ammonia to thereby precipitate said iron as $Fe(OH)_3$ and thereafter separating the precipitate from said aqueous salt solution; and (e) extracting the nickel from the resulting copper- and iron-depleted aqueous salt solution by contacting said aqueous salt solution with a solution in a water immiscible liquid of a liquid ion exchange chelating agent having an extraction specificity for said nickel at a pH range of from about 8.3 to about 9.

2. A process according to claim 1, wherein prior to step (e) the pH value of said copper- and iron-depleted aqueous salt solution is adjusted to a value of about 8.3, whereby step (e) results in substantially all of the nickel being selectively extracted, thereby leaving the cobalt and manganese in said aqueous salt solution.

3. A process according to claim 1, wherein step (e) is carried out with said aqueous salt solution having a pH of about 9, thereby resulting in the extraction of the cobalt along with the nickel and leaving the manganese in said aqueous salt solution.

4. A process according to claim 1 wherein said strong acid is sulfuric acid.

5. A process according to claim 1 wherein said solution of oxalic acid is at least 0.1 molar.

6. A process according to claim 3 wherein said oxalic acid solution is 0.25 molar.

7. A process for recovery of metal values from marine ferromanganese nodules which have been pretreated to remove the copper values therefrom, comprising the steps of:

(a) leaching said pretreated nodules with an aqueous solution of oxalic acid or a mixture of oxalic acid and a strong acid to thereby effect a complete dissolution of both the iron oxide and manganese dioxide matrices of said nodules and to yield a solid residue of silica and aluminosilicates and an aqueous solution containing water soluble salts of nickel, cobalt, manganese, and iron;

(b) separating said solid residue from said aqueous salt solution;

(c) removing substantially all the iron from said aqueous salt solution by adjusting the pH value of said aqueous salt solution to a value of about 9 by addition of ammonia to thereby precipitate said iron as $Fe(OH)_3$ and thereafter separating the precipitate from said aqueous salt solution; and (d) extracting the nickel from the resulting iron-depleted aqueous salt solution by contacting said aqueous salt solution with a solution in a water immiscible liquid of a liquid ion exchange chelating agent having an extraction specificity for said nickel at a pH range of from about 8.3 to about 9.

8. A process according to claim 7, wherein prior to step (d), the pH value of said iron-depleted aqueous salt solution is adjusted to a value of about 8.3, whereby step (d) results in substantially all of the nickel being selectively extracted, thereby leaving the cobalt and manganese in said aqueous salt solution.

9. A process according to claim 7, wherein step (d) is carried out with said aqueous salt solution having a pH of about 9, thereby resulting in the extraction of the cobalt along with the nickel and leaving the manganese in said aqueous salt solution.

10. A process according to claim 7 wherein the solution of oxalic acid is at least 0.1 molar.

11. A process according to claim 10 wherein said aqueous solution of oxalic acid is about 0.25 molar.

12. A process according to claim 7 wherein said strong acid is sulfuric acid.

* * * * *

UNITED STATES PATENT AND TRADEMARK OFFICE

CERTIFICATE OF CORRECTION

PATENT NO. : 4,259,295

DATED : Mar. 31, 1981

INVENTOR(S) : Harry Zeitlin, et al.

It is certified that error appears in the above—identified patent and that said Letters Patent is hereby corrected as shown below:

[75] Inventors: The list of inventors should additionally include -- Michael J. Burzminski, Mt. Vernon, Indiana -- .

Column 4, Line 16: "along" should read -- alone -- .

Signed and Sealed this

Fourth Day of August 1981

[SEAL]

Attest:

GERALD J. MOSSINGHOFF

Attesting Officer

Commissioner of Patents and Trademarks